US005390443A

United States Patent [19]

Emalfarb et al.

[11] Patent Number: 5,390,443

[45] Date of Patent: Feb. 21, 1995

[54] RAILING HANGER

[76] Inventors: Seymour Emalfarb, 1585 Saunders Rd., Riverwoods, Ill. 60015; Bradley S. Emalfarb, 26529 N. Highway 83, Mundelein, Ill. 60004

[21] Appl. No.: 60,589

[22] Filed: May 11, 1993

Related U.S. Application Data

[63] Continuation of Ser. No. 742,936, Aug. 9, 1991, Pat. No. Des. 339,942, and a continuation of Ser. No. 742,940, Aug. 9, 1991, Pat. No. Des. 338,122.

[51] Int. Cl.[6] ..... A01G 9/02

[52] U.S. Cl. ..... 47/67; 211/88; 211/119; 248/302

[58] Field of Search ..... 47/67, 39; 248/302, 248/27.8, 303, 175; 211/119, 113, 106, 86, 87, 88

[56] References Cited

U.S. PATENT DOCUMENTS

| | | | |
|---|---|---|---|
| 1,580,847 | 4/1926 | Moineau | 248/302 |
| 1,957,353 | 5/1934 | Piersall | 248/302 |
| 2,294,151 | 8/1942 | Wooten, Jr. et al. . | |
| 2,318,930 | 5/1943 | Dietrich | 211/119 |
| 2,764,384 | 9/1956 | Kirsch . | |
| 2,807,513 | 9/1957 | Stein | 211/88 |
| 3,013,758 | 12/1961 | Smith | 47/39 |
| 3,219,302 | 11/1965 | Smith . | |
| 3,490,726 | 1/1970 | Mills | 248/312.1 |
| 3,511,461 | 5/1970 | Clark | 248/27.8 |
| 3,532,318 | 10/1970 | Lloyd | 248/302 |
| 4,248,352 | 2/1981 | White | 211/106 |
| 4,418,496 | 12/1983 | Koistinen . | |
| 4,739,582 | 4/1986 | Cullinane | 47/67 |
| 5,181,621 | 1/1993 | Plaehn | 211/88 |

FOREIGN PATENT DOCUMENTS

| | | | |
|---|---|---|---|
| 68844 | 6/1958 | France | 248/302 |

OTHER PUBLICATIONS

Hang Overs TM product label.

*Primary Examiner*—Ramon S. Britts
*Assistant Examiner*—Joanne C. Downs
*Attorney, Agent, or Firm*—Wood, Phillips, VanSanten, Clark & Mortimer

[57] ABSTRACT

A railing hanger is provided for hanging a plant from a deck rail. The railing hanger has a pair of substantially parallel planar brackets each including a pair of integral oppositely opening hooks. An upwardly opening hook on one bracket is joined with an upwardly opening hook on the other bracket by a plurality of transverse U-shaped stiffeners. The brackets and the stiffeners collectively define an upwardly opening container for receiving a plant. A downwardly opening hook on each bracket is selectively self connecting to the top of the railing and resists movement of the container laterally away from the rail. In an installed position, the container is spaced laterally from the railing and the bottom wall of the container is substantially horizontal. A rearwardly extending leg on the railing hanger prohibits movement of the container toward the rail.

7 Claims, 2 Drawing Sheets

RAILING HANGER

This application is a continuation of U.S. Ser. No. 742,936, filed Aug. 9, 1991, now U.S. Pat. Des. No. 339,942, and U.S. Ser. No. 742,940, filed Aug. 9, 1991, now U.S. Pat. Des. No. 338,122.

BACKGROUND OF THE INVENTION

1. Technical Field

This invention relates to an apparatus for hanging an article from an upright support, such as a deck railing, and more particularly, to an apparatus for hanging flowers or plants from a railing.

2. Background Art

Flowers and plants customarily are used to improve aesthetic appeal and attractiveness of a home or yard. Outdoor flowers and plants, in particular, are susceptible to flourishing and beautifying a surrounding area when subjected to appropriate climate conditions. Decorative flowers and relatively small plants typically reside in a somewhat conical pot or, alternatively, in an elongated planter box.

A railing hanger is used to support a flower pot or a planter box from an outdoor or indoor upright support, such as a deck railing or a fence. For instance, a deck railing or fence may extend around any or all of the perimeter of a deck or patio and have a range of heights dependent on the elevation of the deck or patio. A prior railing hanger engages the upper edge of a railing/fence and has a substantially vertical leg which extends downwardly along one side of the railing/fence and supports a flower pot at a desired height above the ground. The depending leg of the hanger and the suspended flower pot rest against the railing/fence under the weight of the pot and soil contained therein. An exemplary railing hanger of the character discussed above is marketed by HMN Corporation of Toledo, Ohio, under the trademark HANG OVERS TM.

A number of problems exist with respect to railing hangers in which a portion of the hanger and a plant or flower suspended thereby rest against a rail.

A plant can be severely damaged if captured between a flower pot and a rail. Further, if a plant is positioned immediately adjacent a rail, a portion of the plant may be shielded from receiving sufficient sunlight or rain water to survive. Where a deck has integral seating built into the rails, adjacently positioned plants pose potential hazards to individuals using the seating: residual moisture may drain from the plant and contact a nearby individual. Also, annoyances associated with windblown potting soil, dead leaves, and insects attracted by plants increase in direct relation to the proximity of the plant to the seating.

Lengthwise contact between the railing hanger and the railing can damage the railing as well as the railing hanger, particularly when the railing hanger is subjected to heavy winds such that the plant and railing hanger repeatedly bounce off the railing. In addition, run off moisture from an adjacent plant easily can soak into the railing and progressively rot or corrode the railing material.

Another problem which exists with respect to hangers for flower pots is that due to the oppositely sloped sidewalls of many conventional flower pots, when a flower pot or planter box is rested flat against a railing in prior railing hangers, the flower pot/planter box necessarily is tipped. Not only does a flower then begin to grow at an angle relative to the flower pot (the appearance of which is unacceptable when the flower pot subsequently is placed on flat ground), but water tends to migrate toward the lowermost edge of the pot and prevent moisture from distributing uniformly throughout the root system and the potting soil.

The present invention is directed to overcoming one or more of the above problems.

SUMMARY OF THE INVENTION

The present invention comprehends an improved railing hanger for hanging a plant from the top of and in laterally spaced relation with an upright support such as a deck railing, a fence, and the like.

An exemplary embodiment of the invention achieves the foregoing object in a railing hanger having a frame engageable with a plant to be hung from a railing. The frame is selectively self connecting to the top of the railing and is resistant to movement laterally away from the railing. Structure is provided for prohibiting movement of the frame laterally toward the railing so that the plant is held in laterally spaced relation with the railing.

More particularly, the railing hanger has pair of substantially parallel planar brackets each including a pair of integral oppositely opening hooks. An upwardly opening hook on one bracket is connected to an upwardly opening hook on the other bracket by a plurality of transverse U-shaped stiffeners. The brackets and the stiffeners collectively define an upwardly opening container for receiving a plant. Each bracket also has a downwardly opening hook integral with the upwardly opening hook on the respective bracket. The downwardly opening hooks are selectively self connecting to the top of the railing. In an installed position, the container is spaced laterally from the railing and the bottom wall of the container is substantially horizontal. A rearwardly extending leg on the railing hanger prohibits movement of the container toward the railing and thereby prevents tipping of a plant supported in the hanger. Engagement of the leg with the railing transfers a portion of the weight of a plant supported by the hanger to the railing and thereby relieves loading on the downwardly opening hooks.

Each downwardly opening hook has a laterally extending base positionable in overlying engagement with the railing and an end attached to the container laterally spaced from the railing when the hook is engaged with the railing. A downwardly extending leg on each bracket is engageable with a vertical face of the railing and resists movement of the container laterally away from the support. Preferably, the leg forms an acute angle with the base of the downwardly opening hook.

In one form of the invention, the container opening is circular.

In another form of the invention, the container opening is rectangular.

In another aspect of the invention, the container has an open upper end and an opposed bottom wall for supporting a flower pot received in the container. A downwardly tapered sidewall extends between the open upper end and the bottom wall of the container whereby the container is suitable for snugly receiving a flower pot having a complementary tapered sidewall. The open upper end of the container is laterally spaced from the railing and engagement of the rearwardly extending leg on the railing hanger with the railing holds the container in a position wherein the bottom wall is substantially horizontal.

Lateral spacing between the container and the railing advantageously reduces damage to the rail and container which otherwise might occur as a result of contact therebetween. Moreover, a plant remotely suspended in the container is fully exposed to sunlight and rain. Moisture in the plant is prevented from draining onto the railing, adjacent deck, or individuals located on the deck.

Importantly, the railing hangers can be used to reliably support a conical flower pot or planter box (that is, the deck hangers are suited for engaging the inclined sidewall of a conical flower pot or planter box) while at the same time maintaining the flower pot/planter box in a vertical orientation so that plants contained therein grow in a desired direction relative to the flower pot/-planter box. Enclosure of the entire base and sidewall of a plant reduces the likelihood of free fall of a supported plant (which can weigh upwards of 50 pounds) and thereby avoids potential injury to individuals below the plant, such as when the deck hanger is used to hang a plant from a balcony in a multi-story building.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and advantages, may be understood from the following description taken in conjunction with the accompanying drawings, in which like reference numerals identify like elements in the figures and in which:

DETAILED DESCRIPTION OF THE INVENTION

Figure 1:
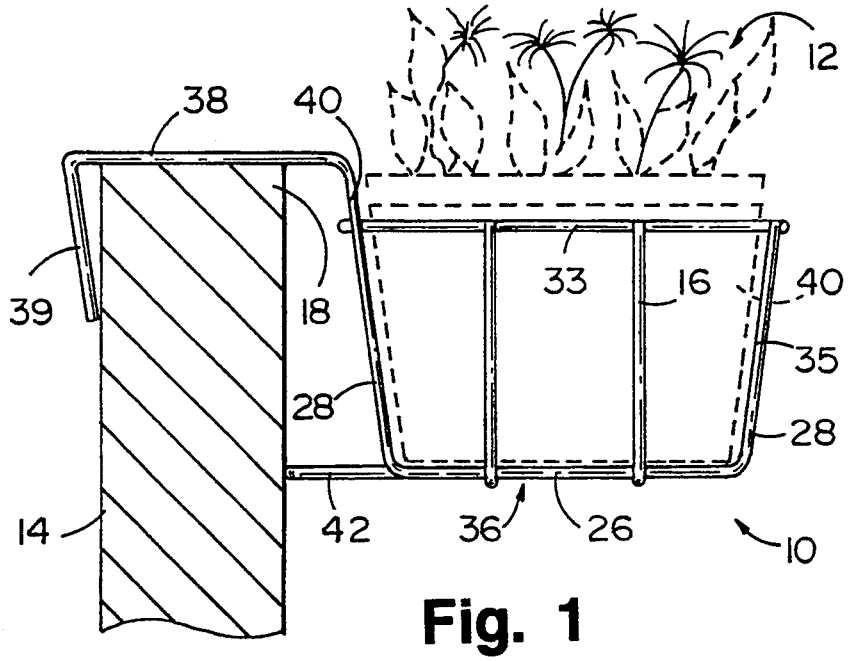
FIG. 1 is a side view of a railing hanger according to the invention with a plant supported by the railing hanger shown in phantom.

A railing hanger according to the invention is generally designated 10 in FIG. 1 for hanging a plant 12 from the top of and in laterally spaced relation with an upright deck railing 14. Of course, it is envisioned that the railing hanger 10 can be used with efficacy for hanging a plant from other upright supports as well, such as, by way of example only, a fence.

Railing hanger 10 has a frame 16 engageable with plant 12 and selectively self connecting to the top 18 of railing 14. As described hereinbelow, frame 16 is resistant to movement laterally away from railing 14 and advantageously is prohibited from movement laterally toward railing 14 so that plant 12 is maintained in laterally spaced relation with the railing.

Figure 2:
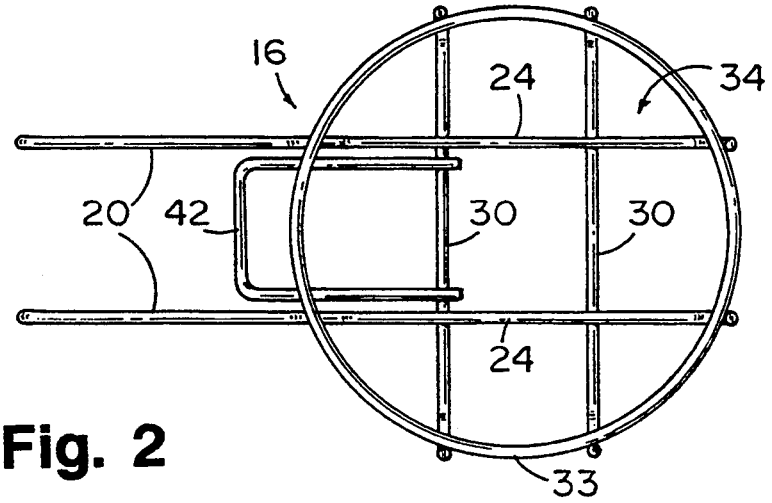
FIG. 2 is a top plan view of the railing hanger.
Figure 3:
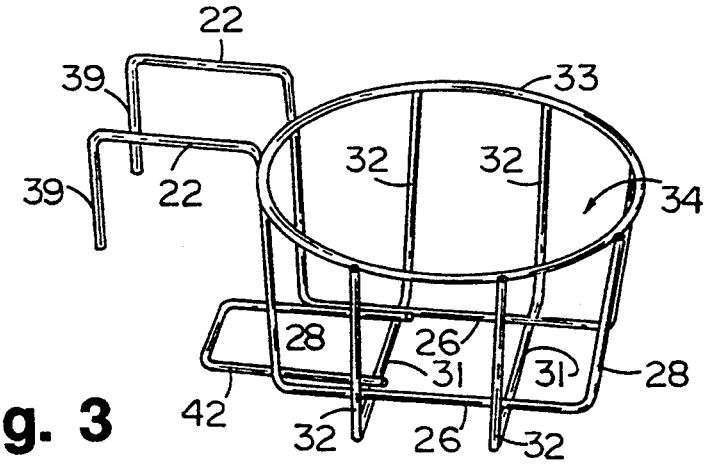
FIG. 3 is a perspective view of the railing hanger.

More particularly, and referring also to FIGS. 2 and 3, railing hanger 10 has pair of substantially parallel planar brackets 20 each including a pair of integral oppositely opening hooks 22 and 24. Brackets 20, as well as additional components described below relative to the construction of frame 16, are somewhat resilient yet are capable of retaining their configuration described herein. In the exemplary embodiment, the components consist of plastic coated metal wires joined together by any one of many known techniques suitable for achieving the stated object, for instance, as by spot welding.

Each upwardly opening hook 24 has a substantially straight base 26 intermediate a pair of upwardly divergent legs 28. Base 26 on one upwardly opening hook 24 is connected to base 26 on the other upwardly opening hook 24 by a pair of transverse generally U-shaped stiffeners 30. Each stiffener 30 has a substantially straight base 31 intermediate a pair of upwardly divergent legs 32. Base 31 on each stiffener 30 is perpendicularly connected to base 26 of both upwardly opening hooks 24. Upper ends of legs 28 on hooks 24 and upper ends of legs 32 on stiffeners 30 are joined by a circular ring 33 and collectively define a container 34 on frame 16 for receiving plant 12. Container 34 has an open upper end defined by ring 33 and a bottom wall 36 defined by base 26 one each hook 24 and base 31 on each stiffener 30. Legs 28 and 32 define a downwardly tapered sidewall 35 on container 28 extending between ring 33 and bottom wall 36.

The downwardly opening hook 22 on each bracket 20 is smoothly integrated with an upwardly opening hook 24 on a respective one of brackets 20. Particularly, each hook 22 has a substantially straight base 38 positionable in overlying engagement with top 18 of railing 14. Each hook 22 also has a pair of mutually parallel legs 39 and 40 depending integrally from base 38. In the exemplary embodiment legs 39 and 40 are skewed relative to base 38, which is to say that legs 39 and 40 form an acute angle with base 38 and bottom wall 36 of container 34. Thus, leg 39 is directed downwardly and toward railing 14. Interference between leg 39 on each bracket 20 and railing 14 resists movement of container 34 laterally away from the railing. Of course, the invention also envisions alternative embodiments wherein the leg 39 is substantially perpendicular to the base 38. As illustrated in FIG. 1, base 38 of each hook 22 extends laterally beyond railing 14 (FIG. 1) whereby the open end of container 34 is laterally spaced from the railing.

A transverse generally U-shaped leg or bumper 42 extends rearwardly of frame 16 and lies substantially in the plane defined by bottom wall 36. Leg 42 is attached to base 31 of one of the stiffeners 32 and is located between brackets 20. Engagement of leg 42 with railing 14 prohibits movement of container 28 toward the railing and, in combination with skewed leg 39 on each bracket 20, effectively locks railing hanger 10 to railing 14 and securely holds container 34 (as well as plant 12 received therein) spaced apart from the railing. Engagement of leg 42 with railing 14 advantageously transfers a portion of the weight of plant 12 supported by hanger 10 to a pressure point spaced below the top 18 of the railing and thereby relieves loading on the downwardly opening hooks 22. The length of leg 42 is selected such that bottom wall 30 remains substantially horizontal whereby plant 12 in container 28 is vertical and does not tip.

Notably, the spaced apart relationship between container 28 and plant 12 (that is, the length differential between leg 42 and base 38 on brackets 20) permits the frusto-conical pot 40 in which plant 12 resides to snugly engage the complementary taper of sidewall 32 and yet remain in a substantially upright orientation. Enclosure of the entire base and sidewall of plant 12 reduces the likelihood of free fall and thereby avoids potential injury to individuals below the plant, such as when deck hanger 10 is used to hang a plant from a balcony in a multi-story building.

Figure 4:
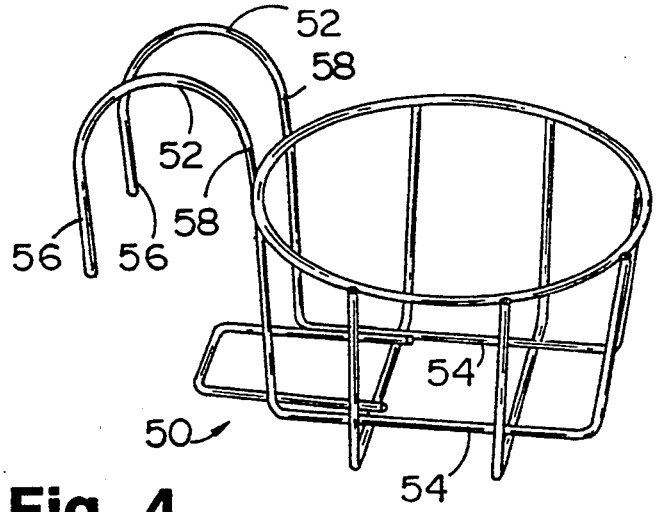
FIG. 4 is a perspective view of an alternative embodiment of the railing hanger having arcuate hooks.

An alternative railing hanger is generally designated 50 in FIG. 4. The principle distinction between railing hanger 50 and railing hanger 10 discussed relative to FIGS. 1–3 is that railing hanger 50 has arcuate downwardly opening hooks 52 for engaging the top of rail 14. Consequently, railing hanger 50 is particularly well suited for use with rails having an arcuate top surface.

Each arcuate hook 52 is smoothly integrated with a corresponding upwardly opening hook 54 and includes a pair of substantially parallel legs 56 and 58. Leg 56 of each hook 54 is engageable with railing 14 and opposes movement of railing hanger 50 away from the railing. Railing hanger 50 is, in all other respects, substantially identical to railing hanger railing hanger 10 and operation thereof is incorporated by reference to the discussion of FIGS. 1–3, above.

Figure 5:
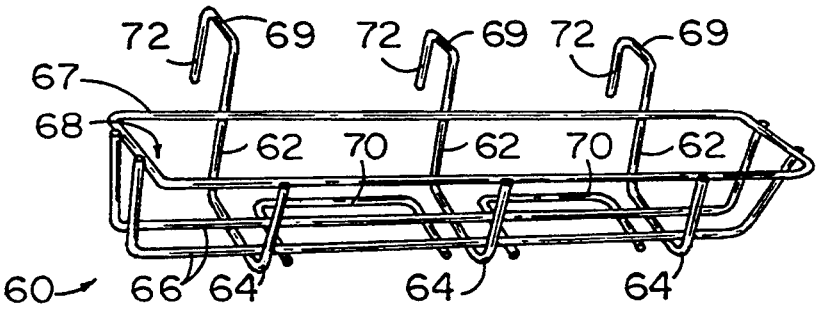
FIG. 5 is a side view of a second alternative embodiment of the railing hanger having a container with a rectangular opening.

FIG. 5 illustrates a railing hanger 60 having a three substantially parallel planar brackets 62. Upwardly opening hooks 64 on each bracket 62 are interconnected by a plurality of transverse U-shaped stiffeners 66. Upper ends of hooks 64 and stiffeners 66 are joined by a rectangular frame 67 and collectively define a container 68 for receiving an elongated planter box (not shown). A pair of transverse generally U-shaped legs 70 extend rearwardly of railing hanger 60 and lie substantially in the plane defined by the bottom wall of container 68. Engagement of legs 70 with railing 14 prohibit movement of container 68 toward the railing and, in combination with a skewed leg 72 on each bracket 62, effectively lock railing hanger 10 to railing 14 and securely holds container 68 (as well as a planter box received therein) spaced apart from the railing.

Figure 6:
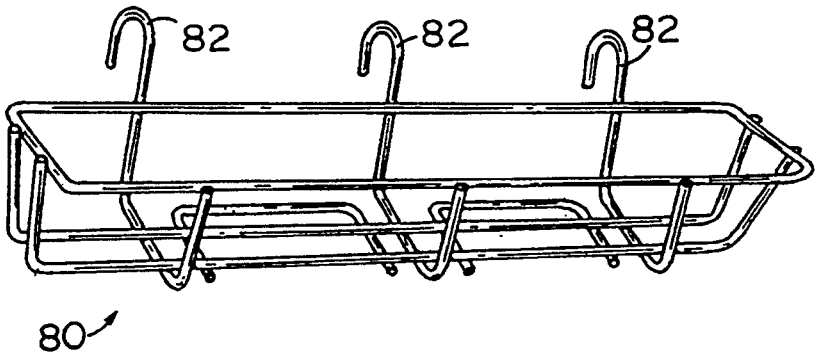
FIG. 6 is a perspective view of a modified form of the second alternative embodiment having arcuate hooks.

Alternatively, and as shown in FIG. 6, a railing hanger 80 is generally similar to railing hanger 60 in FIG. 5 and includes, in addition, arcuate downwardly opening hooks 82 for engaging the top of rail 14. Consequently, railing hanger 80 is particularly well suited for hanging an elongated planter box from rails having an arcuate top surface.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

what is claimed is:

1. A railing hanger for hanging an article from the top of and in laterally spaced relation with an upright support, comprising:

first means defining a frame having a vertically upwardly opening container with a bottom wall for supporting an article received in the container;

second means for selectively self connecting said first means to the top of an upright support and holding an upper end of said container in a laterally spaced relationship with the upright support, said second means including means for resisting movement of said container laterally away from the upright support; and third means cooperating with said first and second means for holding said container in laterally spaced relation with the upright support, said first means comprising a plurality of vertically upwardly opening hooks, each hook having a substantially straight base intermediate a pair of vertically upwardly extending legs, wherein said legs collectively define a sidewall on the container, upper ends of said legs defining an opening in the container, said second means comprising a plurality of vertically downwardly opening hooks, each hook having a substantially straight base for engaging the top of the upright support and a downwardly extending straight leg for engaging a side of the upright support remote from the container whereby the railing hanger can be positioned on the top of the upright support in a vertically downwardly directed generally straight-line motion, said third means comprising a spacer member extending from said bottom wall and located between said container sidewall and a vertical face of said upright support below said second means for prohibiting movement of the container bottom wall toward the upright support.

2. The railing hanger of claim 1 in which said third means are suitable for holding the bottom wall of the container substantially horizontal so that an article supported thereon is disposed in a substantially vertical orientation.

3. A railing hanger for hanging an article from the top of and in laterally spaced relation with an upright support, comprising:

first means defining a frame having a vertically upwardly opening container with a bottom wall for supporting an article received in the container;

second means for selectively self connecting said first means to the top of an upright support, said second means including means for resisting movement of said container laterally away from the upright support; and means extending from said bottom wall cooperating with said first and second means for holding said container in laterally spaced relation with the upright support, said first means comprising a plurality of upwardly opening hooks, each hook having a substantially straight base intermediate a pair of upwardly divergent legs, wherein said legs collectively define a tapered sidewall on the container, upper ends of said legs defining an opening in the container, said second means comprising a plurality of vertically downwardly opening hooks, each hook having a substantially straight base for engaging the top of the upright support and a downwardly extending straight leg for engaging a side of the upright support remote from the container whereby the railing hanger can be positioned on the top of the upright support in a vertically downwardly directed generally straight-line motion.

4. The railing hanger of claim 3 in which said container opening is circular.

5. The railing hanger of claim 3 in which said container opening is rectangular.

6. A railing hanger for hanging an article from the top of an upright support, comprising:

first means defining a frame having a vertical container with an open upper end and a closed bottom end for supporting an article received in the container, said container having a downwardly tapered sidewall extending between said open upper end and said bottom wall whereby the container is suitable for receiving an article having a complementary taper;

second means on the frame for selectively self connecting said frame to the top of an upright support, said second means including means for resisting movement of said container laterally away from the upright support; and third means integral with the bottom end of the frame and engageable with a vertical face of the upright support below said container upper end for holding the bottom end of the container at a lateral distance from the upright support which is greater than a lateral distance between the upper end of the container and the upright support, said second means comprising a plurality of vertically downwardly opening hooks, each hook having a substantially straight base for engaging the top of the upright support and a downwardly extending straight leg for engaging a side of the upright support remote from the container whereby the railing hanger can be positioned on the top of the upright support in a vertically downwardly directed generally straight-line motion.

7. The railing hanger of claim 6 in which said upper end of the container is laterally spaced from the upright support.

* * * * *